US007806613B2

(12) United States Patent
Mondloch et al.

(10) Patent No.: US 7,806,613 B2
(45) Date of Patent: Oct. 5, 2010

(54) DRYWALL COMPOUND DISPENSING SYSTEM

(75) Inventors: Steven J. Mondloch, Kaukauna, WI (US); Jeffrey L. Denkins, Kaukauna, WI (US)

(73) Assignee: Apla-Tech, Inc., Kaukauna, WI (US)

( * ) Notice: Subject to any disclaimer, the term of this patent is extended or adjusted under 35 U.S.C. 154(b) by 1059 days.

(21) Appl. No.: 11/530,505

(22) Filed: Sep. 11, 2006

(65) Prior Publication Data

US 2007/0077114 A1 Apr. 5, 2007

Related U.S. Application Data

(60) Provisional application No. 60/719,308, filed on Sep. 21, 2005.

(51) Int. Cl.
*A46B 11/00* (2006.01)

(52) U.S. Cl. ..... 401/48; 425/87

(58) Field of Classification Search ..... 401/48, 401/138, 140; 425/87
See application file for complete search history.

(56) References Cited

U.S. PATENT DOCUMENTS

| | | | | |
|---|---|---|---|---|
| 2,824,442 | A * | 2/1958 | Ames | 425/87 |
| 3,116,511 | A * | 1/1964 | Hoveland | 401/171 |
| 4,516,868 | A | 5/1985 | Molnar | |
| 4,767,297 | A | 8/1988 | Mower et al. | |
| 5,137,386 | A | 8/1992 | Mower | |
| 5,535,926 | A | 7/1996 | Blitz et al. | |
| 5,670,182 | A | 9/1997 | Mower | |
| 5,814,351 | A | 9/1998 | Mower | |
| 5,902,451 | A | 5/1999 | O'Mara et al. | |
| 6,146,039 | A | 11/2000 | Pool et al. | |
| 6,484,782 | B1 | 11/2002 | Lewis et al. | |
| 6,540,856 | B2 | 4/2003 | O'Mara et al. | |
| 6,565,252 | B2 | 5/2003 | Dillinger et al. | |
| 6,874,557 | B2 | 4/2005 | Jungklaus | |
| 6,874,965 | B1 | 4/2005 | Mondloch et al. | |
| 6,877,923 | B2 | 4/2005 | Grayden | |
| 2004/0159406 | A1 | 8/2004 | Jungklaus | |
| 2004/0182460 | A1 | 9/2004 | Castagnetta, Jr. | |
| 2005/0061449 | A1 | 3/2005 | Jungklaus | |
| 2005/0100386 | A1 | 5/2005 | Murray | |

FOREIGN PATENT DOCUMENTS

| | | |
|---|---|---|
| GB | 805967 | 12/1958 |
| WO | 0032319 | 6/2000 |

* cited by examiner

*Primary Examiner*—David J Walczak
(74) *Attorney, Agent, or Firm*—Andrus, Sceales, Starke & Sawall, LLP

(57) ABSTRACT

A drywall compound dispensing system for applying drywall compound to a wallboard has a delivery tube for delivering drywall compound entirely therethrough provided with a supply end connected to a source of pressurized drywall compound, and a dispenser end opposite to the supply end connected for pivotal movement with a drywall compound dispensing head. A tandem control lever arrangement is located at the supply end of the delivery tube and is engaged by one hand of the user for supplying manual or continuous flow of drywall compound through the delivery tube, and disabling pivotal movement of the dispensing head.

22 Claims, 6 Drawing Sheets

DRYWALL COMPOUND DISPENSING SYSTEM

CROSS REFERENCE TO RELATED APPLICATION

This application relates to and claims priority from Provisional Application U.S. Ser. No. 60/719,308 filed Sep. 21, 2005.

FIELD OF THE INVENTION

This invention relates generally to a drywall compound dispensing system for applying mastic material, drywall compound or similar material over tape joints between adjacent pieces of wallboard. More particularly, the present invention is directed to control structure for improving the efficiency and versatility of drywall compound application during a finishing operation.

BACKGROUND OF THE INVENTION

Drywall has become a dominant material in the production of interior building partitions. In particular, interior building partitions generally comprise a vertical stud wall which is used as a support for pre-formed drywall panels that are attached to the stud wall. Joints between adjacent panels of drywall are usually taped, and finished with joint or drywall compound. One type of apparatus or tool for applying joint compound is disclosed in U.S. Pat. No. 2,815,142 issued Dec. 3, 1957. This apparatus mechanically applies tape and joint compound contemporaneously. After the tape and the first coat of joint compound has been applied over the joint, it is typical to apply multiple coats of joint compound. The multiple coats are typically applied using finishing tools such as a corner head, a coater, a flat box or other box tool.

A traditional box tool is constructed with a slotted orifice in the bottom surface which acts as an outlet through which the drywall compound is dispensed as well as refilled. A movable pressure plate on the box tool has springs attached to bias it to an open position. A handle pivotably affixed to the pressure plate allows an operator to apply inward pressure to the pressure plate to force drywall in the box tool through the outlet slot and onto a joint or the like. The expelled drywall compound is then spread and smoothed by a blade-like projection on the box tool as the box tool is moved along a joint. A cable is controlled by a brake lever on the handle to selectively lock the box tool on the handle and prevent relative pivotal motion thereof. One glaring inefficiency associated with use of traditional box tools in finishing is the frequent requirement of refilling the relatively small box tool which requires a lot of additional time and is labor intensive adding to the cost of the job.

More recently, box tools have been supplied with a source of pressurized drywall which is continuously fed by a supply line into and through the handle from a pump supply device for dispersion into the box tool so as to make the dispensing system more efficient and eliminate the costly downtime problem noted above. One known finishing tool system includes a handle equipped with a brake lever as well as an on/off switch and a volumetric control to regulate the continuous flow of pressurized drywall compound to the box tool. This system allows an operator to continuously feed drywall compound to the box tool and simultaneously control locking the box tool. However, this system is not designed to provide a separate optional manual control to vary the flow of pressurized drywall compound. In addition, such system does not provide relief valve protection in the event of excessive pressure buildup of drywall compound. The absence of these features detracts from the productivity, usefulness and ease of operating the box tool dispenser.

Accordingly, it is desirable to provide a system for applying drywall compound to wallboard joints with an improved control arrangement which will overcome the deficiencies of the prior art and enhance the operability, speed, efficiency and versatility of a drywall finishing operation.

SUMMARY OF THE INVENTION

It is one object of the present invention to provide a drywall compound dispensing system providing automatic, continuous or manual variable flow of drywall compound from a source of pressurized drywall compound to a dispensing head while simultaneously allowing selective locking of the pivoting dispensing head in a manner accessible to one hand of an operator.

It is also an object of the present invention to provide a finishing system in which a movable biased plate arrangement is provided to selectively lock and unlock pivotal movement of a dispensing head on a drywall compound delivery tube.

It is another object of the present invention to provide a box tool dispensing system wherein the drywall compound delivery tube is constructed with a relief valve which will expel drywall compound therefrom in the presence in excessive pressure.

In one aspect of the invention, a drywall compound dispensing system is provided for applying drywall compound to a wallboard. The system includes a delivery tube for delivering drywall compound entirely therethrough. The delivery tube has a supply end connected to a source of pressurized drywall compound, and a dispenser end opposite the supply end connected for pivotal movement with a drywall compound dispensing head. A control arrangement is located at the supply end of the delivery tube and is provided with a first movable lever spaced from a second movable lever. Both the first and second movable levers are grasped and selectively operated by fingers of one hand of a user. The first lever has an unlocked position for manually controlling flow of drywall compound into the delivery tube, and a locked position for enabling an automatic, continuous flow of drywall compound into the delivery tube. The second movable lever provides manual control for selectively allowing and preventing pivotal movement of the dispensing head at the dispensing end of the delivery tube.

The delivery tube includes a pressure regulator for controlling volume of flow of drywall compound. The delivery tube also includes a relief valve for allowing the expulsion of drywall compound out of the delivery tube in the presence of excessive pressure in the delivery tube. The relief valve includes a venting hole formed in the outer wall of the delivery tube, and an expandable and retractable shrink sleeve surrounding the delivery tube and normally covering the venting hole. A deflector collar is spaced from and surrounds the shrink sleeve and the delivery tube. The deflector has an open end for expelling drywall therefrom. The delivery tube includes a knurled tubular hand grip aligned with the first and second levers at the supply end. The dispenser end of the delivery tube includes a ball dispenser enabling the pivotal movement with the drywall compound dispensing head. The ball dispenser includes a shaft permitting pivotal movement of the drywall compound dispenser head about a horizontal axis only. A back wall of the drywall compound dispensing head is provided with a movable biased plate arrangement for receiving the ball dispenser in a socket formed therein. The movable bias plate arrangement is connected by a cable to the second movable lever. The drywall compound dispenser head normally pivots upon the ball dispenser and actuation of the second movable lever causes the cable to move the plate arrangement such that the ball dispenser is locked into frictional engagement so that there is no pivotal movement of the dispenser head relative to the ball dispenser. In the preferred embodiment, the drywall compound dispenser head is a dispenser box movable along a wallboard.

The movable biased plate arrangement includes a first plate connected to the back wall of the dispensing head and having a first opening. A second plate is connected to the first plate and has a second opening. A third plate is connected in spaced biased relationship to the second plate. A fourth plate is connected to the third plate and has an opening for retaining the cable. The socket and the first, second and third openings are all in alignment with each other and receive the ball dispenser. The second lever in the cable is actuated to pull the second and third plates together and frictionally lock the ball dispenser. The control arrangement includes a rotatable locking device for placing the first movable lever in the locked and unlocked positions. The first lever and the second lever are pivotable about a first pivot axis and a second pivot axis, respectively, which are parallel to each other.

In another aspect of the invention, a drywall compound dispensing system is provided for applying drywall compound to a wallboard of the type having a delivery tube for delivering drywall compound entirely therethrough provided with a supply end connected to a source of pressurized drywall compound, and a dispenser end opposite to the supply end connected for pivotal movement with a drywall compound dispensing end. The invention is improved by a tandem control lever arrangement located at the supply end of the delivery tube and engaged by one hand of a user for optionally providing manual and automatic, continuous flow of drywall compound through the delivery tube, and disabling pivotal movement of the dispensing head. The tandem control lever arrangement is located within a handle framework. A movable biased plate arrangement is connected to the dispensing head for allowing and preventing pivotal movement of the dispensing head relative to the dispenser end. A relief valve is positioned in the delivery tube between the supply end and the dispensing end for allowing the expulsion of drywall compound out of the delivery tube in the presence of successive pressure of drywall compound in the delivery tube.

Other objects, features and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE PREFERRED EMBODIMENT

Figure 1:
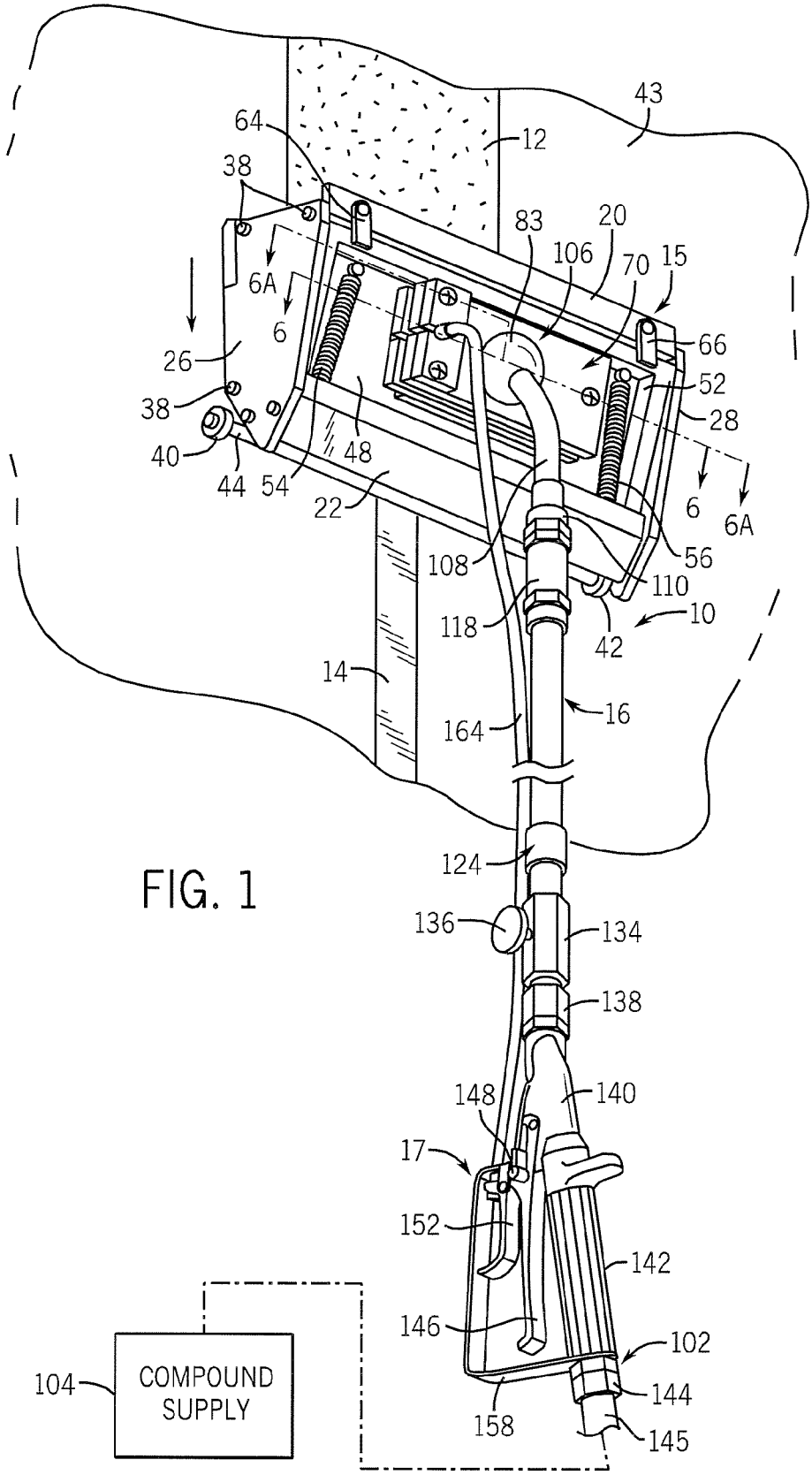
FIG. 1 is a perspective view of a flat box dispensing system in operation in accordance with the present invention.

Referring now to the drawings, FIG. 1 illustrates a dispensing and finishing system 10 for applying drywall compound 12 over a tape 14 covering a wallboard joint. The system 10 is generally comprised of a dispensing head 15 supplied with drywall compound 12, a delivery tube 16 and a control arrangement 17.

Figure 3:
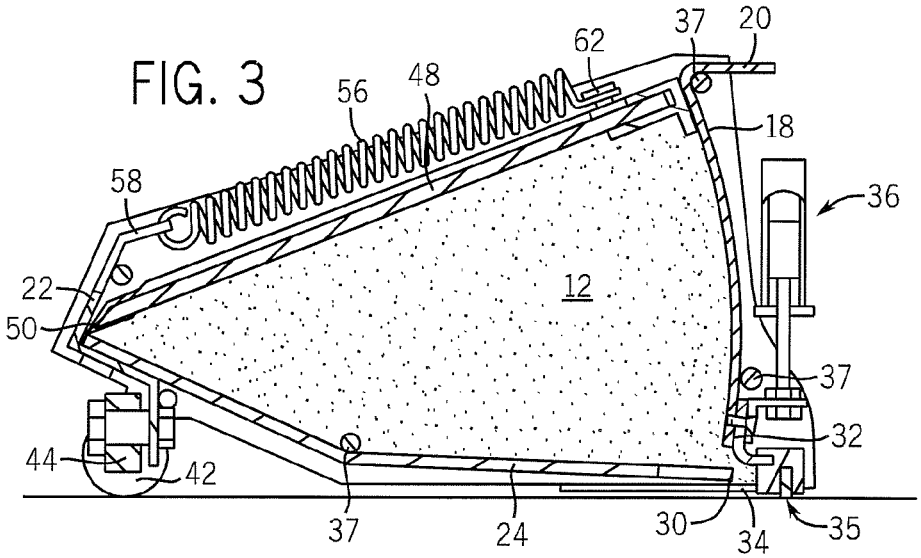
FIG. 3 is a sectional view of the flat box filled with drywall compound taken on line 3-3 of FIG. 2.
Figure 4:
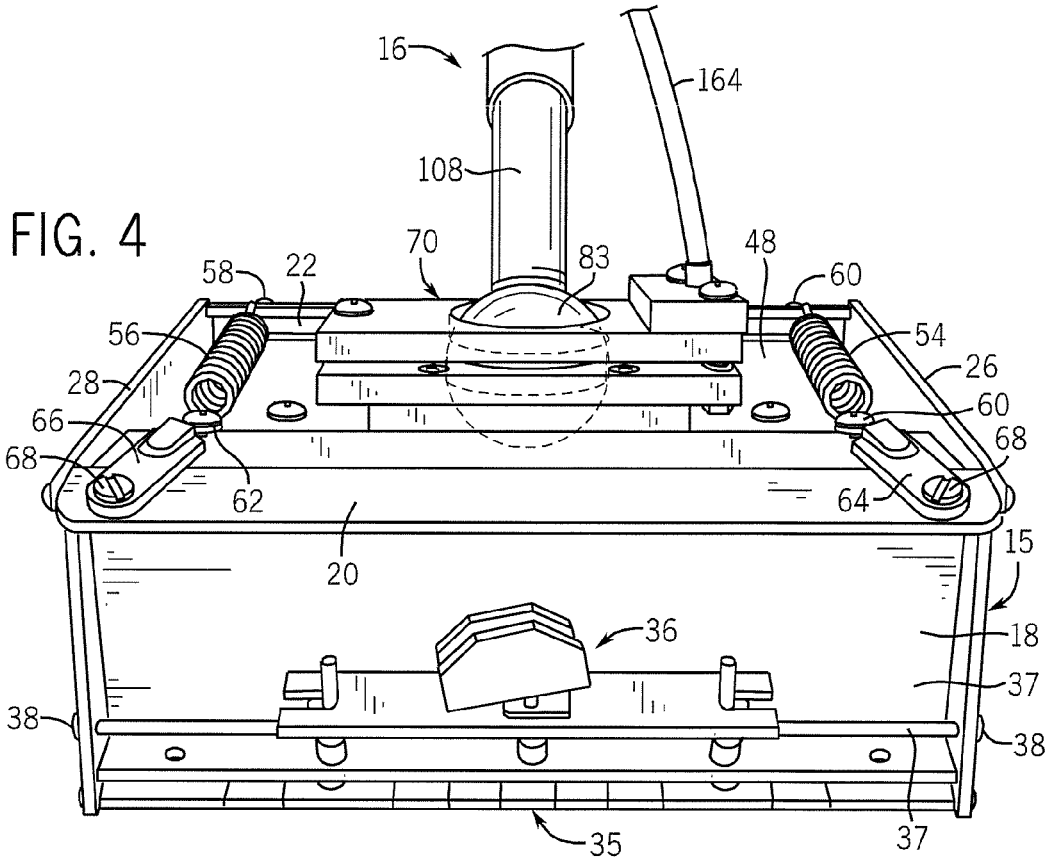
FIG. 4 is a front perspective view of the flat box shown in FIG. 2.

In the preferred embodiment, the dispensing head 15 is shown as a box tool commonly known in the finishing industry as a flat box which may be variously sized and configured. The flat box 15 includes a front plate 18 with a front lip 20, a back plate 22, a bottom plate 24 and a pair of side plates 26,28. As seen in FIG. 3, the bottom plate 24 has a forward edge 30 spaced from a bottom edge 32 of front plate 18 to define an outlet slot 34 from which the drywall compound 12 is dispensed. As seen in FIG. 4, the front plate 18 carries a flexible blade assembly 35 along its lower end for distributing and contouring drywall compound 12 dispensed through outlet slot 34. The front plate 18 further includes a known mechanism 36 for changing the curvature of the blade assembly 35 thereby providing a crown adjustment for the dispensed drywall compound 12. The side plates 26,28 are held in place by laterally extending tension rods, such as 37, which are threaded on their ends and tensioned by nuts 38. A pair of wheels 40,42 designed to run along the wallboard 43 is rotatably mounted on ends of a transversely extending support bar 44 which is pivotally connected to back plate 22 by a pivot pin 46.

Figure 5:
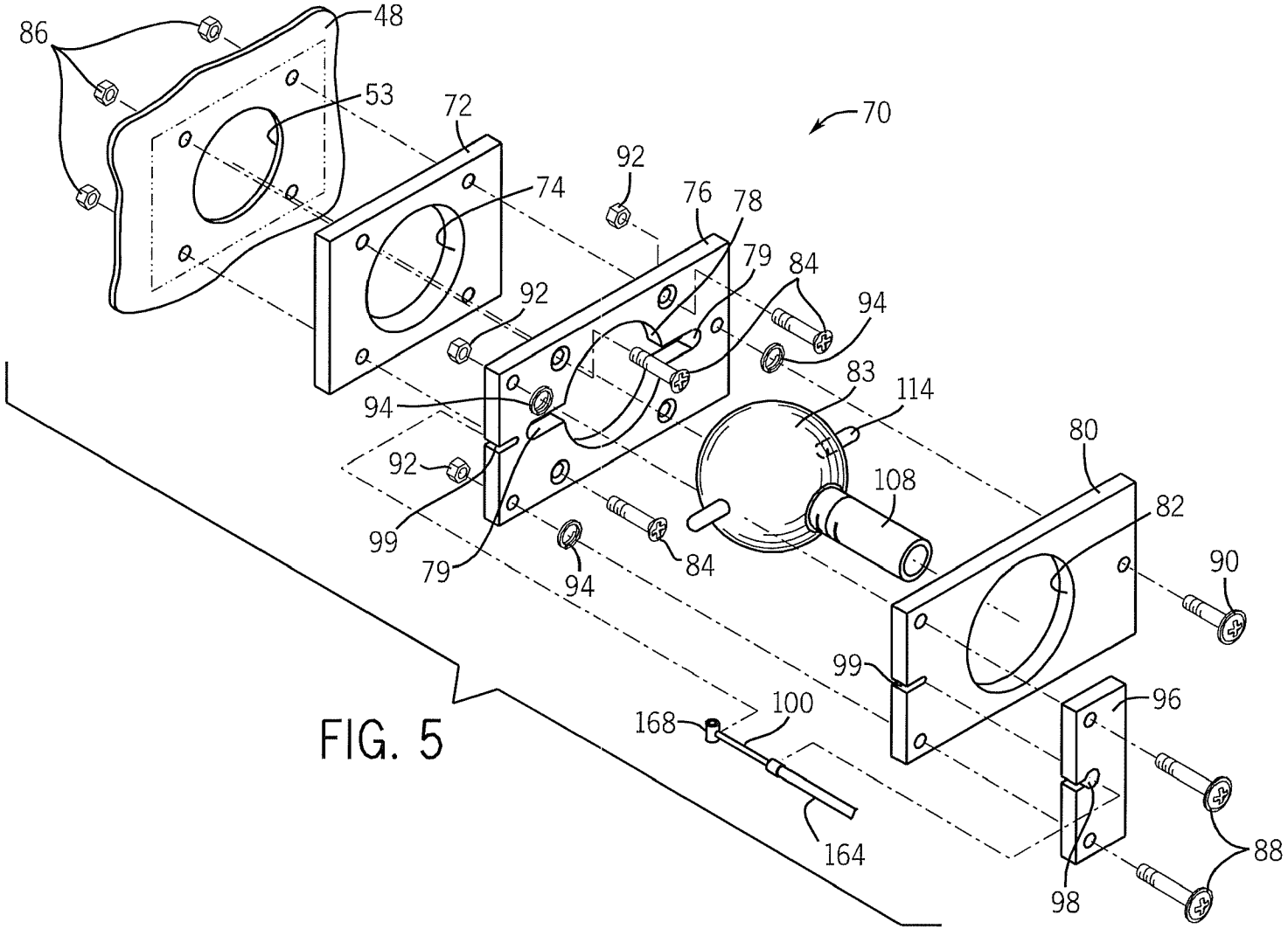
FIG. 5 is an exploded view of the movable connection between the flat box and the delivery tube.

A movable pressure plate 48 extends completely across the entire area of the flat box 15 from side to side and from front to back, and has a pivot edge 50 (FIG. 3) captured within and loosely and pivotally bearing against an inner surface of back plate 22. The pressure plate 48 has a sealing gasket 52 secured to its front and side edges to bear against the front and side plates of the flat box 15 to seal the interior thereof. The pressure plate 48 is formed with a round socket 53 as shown in FIG. 5. Pressure plate 48 is urged about a rear fulcrum by means of a pair of tension springs 54,56 connected between retainers 58,60 on the back plate 22 and studs 60,62 fixed to the pressure plate 48 near the sides thereof. Movable pressure plate 48 is held in closed position by a pair of clips 64,66 rotatably attached to the front lip 20 by screws 68.

Figure 6A:
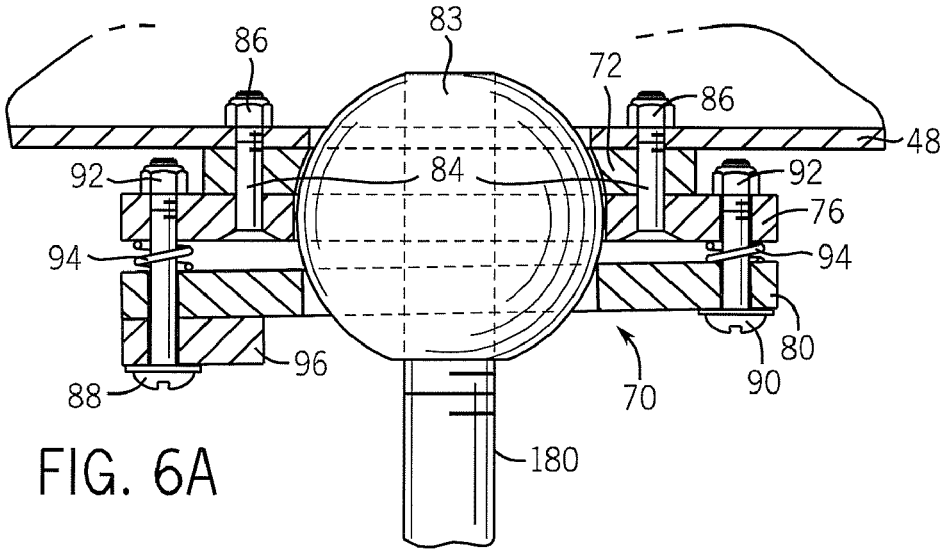
FIG. 6, 6A and 7 are sectional views showing different positions of a locking arrangement for the movable connection with FIGS. 6 and 6A being taken on line 6-6, and 6A-A of FIG. 1.
Figure 6:
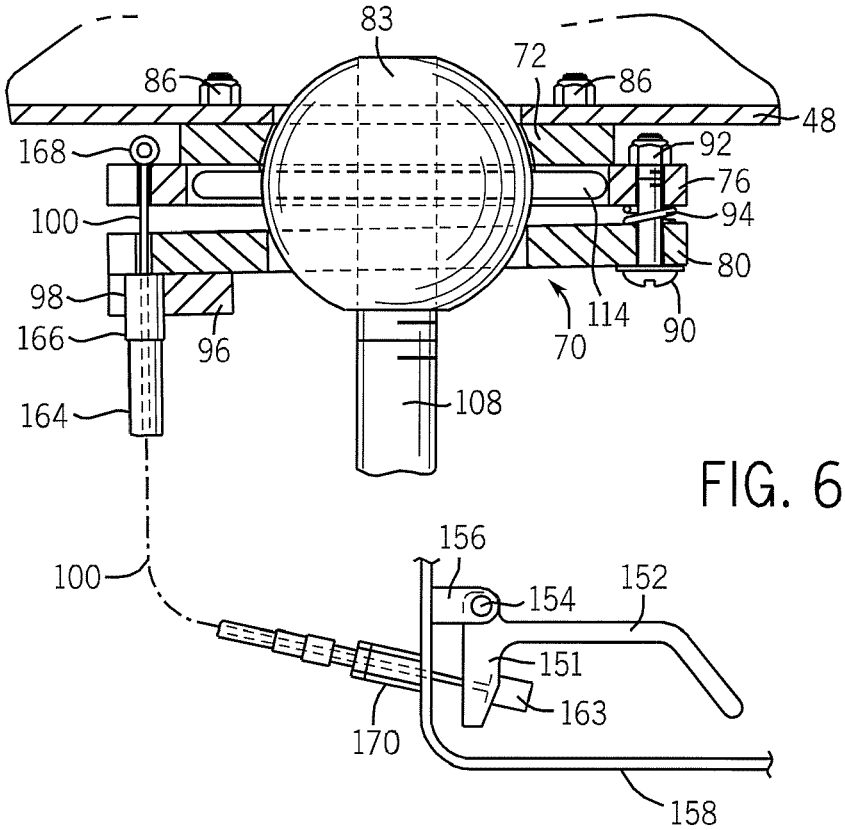
Figure 7:
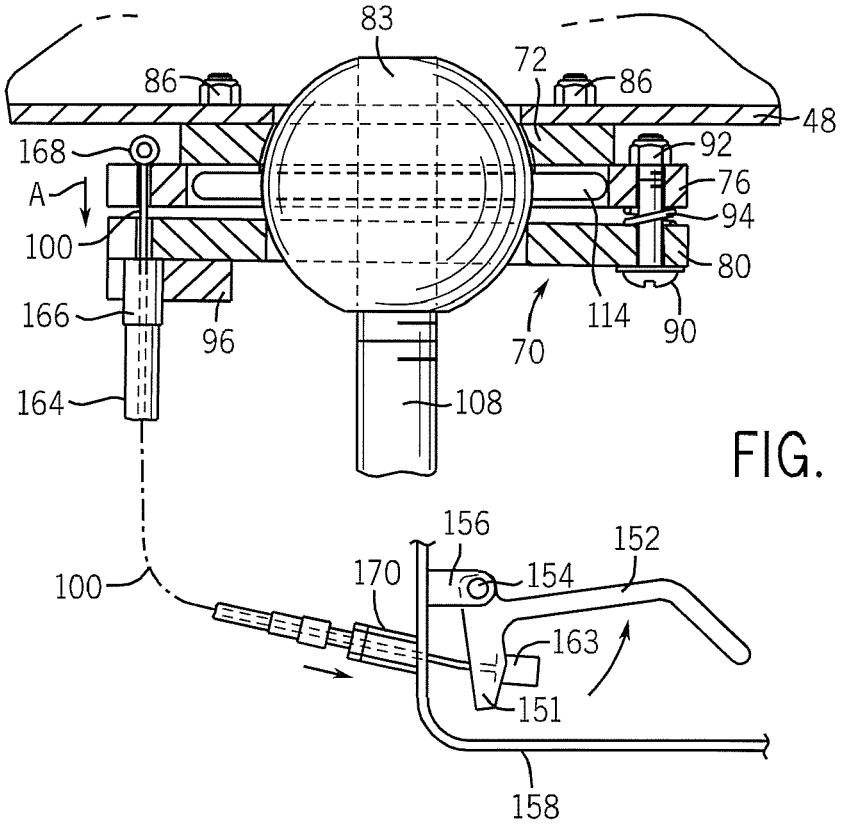

In accordance with one feature of the invention, the pressure plate 48 carries a movable biased plate arrangement 70 used in conjunction with the control arrangement 17 to selectively allow and prevent pivotal movement of the flat box 15 relative to the delivery tube 16. Referring to FIGS. 5-7, the movable biased plate arrangement 70 includes a first rectangular plate 72 with a first round opening 74, a second rectangular plate 76 with a second round opening 78 and a third rectangular plate 80 with a third round opening 82. Second opening 78 includes lateral slot extensions 79 for a reason to be understood hereafter. The socket 53 formed in pressure plate 48 and the openings 74,78,82 are all sized to receive a ball dispenser 83 on delivery tube 16, and all lie in alignment with each other. Screws 84 and nuts 86 are used to connect first plate 72 and second plate 76 to the pressure plate 48. Screws 88 and 90 and nuts 92 hold the second plate 76 and the third plate 80 together with three springs 94 surrounding shafts of the screws 88,90 and positioned between the plates 76,80. Screws 88 also hold a fourth rectangular plate 96 upon the third plate 80. The plates 72,76,80 and 96 are formed with appropriate throughholes to accommodate passage of the screws 84,88,90. The fourth plate 96 is also formed with a retainer opening 98, while plates 76 and 80 include retainer openings 99, for retaining a braking cable 100 of the control arrangement 17.

Figure 2:
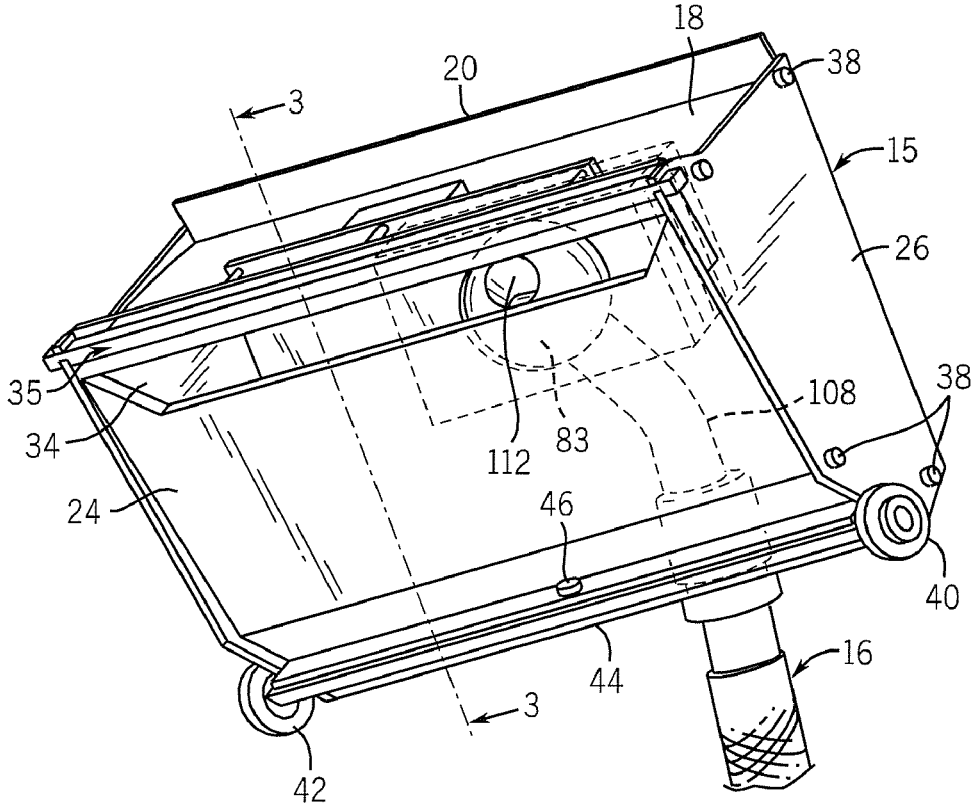
FIG. 2 is a bottom perspective view of a flat box used in the system of FIG. 1.

The delivery tube 16 is designed to transport drywall compound 12 entirely therethrough from a supply end 102 connected to a source 104 of pressurized drywall compound 12 to a dispensing end 106 movably connected to the flat box 15. The dispensing end 106 includes a spherical or ball dispenser 83 connected to a curved arm tube 108 and a coupling 110. The ball dispenser 83 is provided with an outlet hole 112 (FIG. 2) which communicates with the interior of the flat box 15. The outer surface of the ball dispenser 83 is received in the openings 74,78,82 and the socket 53 of the movable plate arrangement 70. A shaft 114 passes through the ball dispenser 83 and prevents the ball dispenser 83 from moving left to right so that the flat box 15 will not laterally flip flop off the wallboard 43 during the finishing operation. As a result, the flat box 15 will pivot only about a horizontal axis. The shaft 114 fits loosely in the lateral slot extensions 79 and opening 78 formed in second plate 76. A valve member 118 is joined to the coupling 110 and includes a poppet valve (not shown) for controlling flow of the drywall compound 12 to the ball dispenser 83. Connected to the valve member 118 is a main supply conduit 120 which is provided with a vinyl sleeve 122 (FIG. 9) that serves as a gripping surface for one hand of the user.

Figure 9:
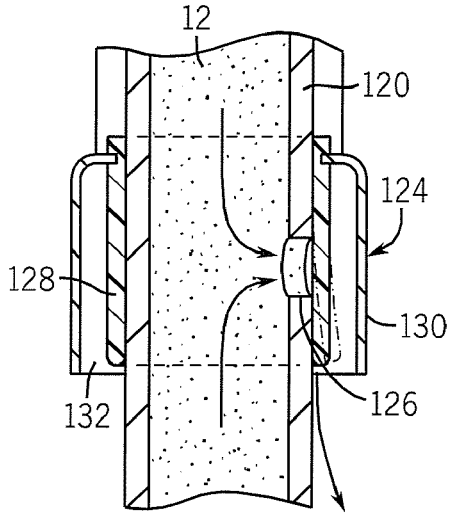
FIG. 9 is a sectional view of a relief valve used in the control arrangement of FIG. 8*a*.

In accordance with another feature of the invention, a relief valve 124 is provided on the main supply conduit 120 allowing the expulsion of drywall compound 12 out of the delivery tube 16 in the presence of excessive back pressure therein. As best seen in FIGS. 8 and 9, the relief valve 124 includes a venting hole 126 formed in an outer wall of the main supply conduit 120. An expandable and retractable shrink sleeve or band 128 surrounds the conduit 120 and normally covers and seals the hole 126. A deflector collar 130 is spaced from and surrounds the shrink sleeve 128 and the supply conduit 120. The deflector collar 130 has an open end 132 for expelling drywall compound 12 therefrom.

A pressure regulator 134 is included in the main supply conduit 120 and has a rotatable adjustment disk 136 for selectively altering the volume of the drywall compound 12 flowing through the delivery tube 16. Following a further coupling 138, the main supply conduit 120 includes an angled branch 140 which passes through a knurled, tubular hand grip 142 and terminates in an inlet 144 at the supply end 102 which is connected such as by supply hose 145 (FIG. 1) to the source 104 of pressurized drywall compound 12.

In accordance with a further feature of the invention, the control arrangement 17 in the form of a tandem control lever arrangement is located at the supply end 102 of the delivery tube 116. The control arrangement 17 is engaged by one hand of the user for optionally providing manual or automatic continuous flow of drywall compound 12 through the delivery tube 16, and substantially disabling pivotal movement of the dispensing head 15 relative to the delivery tube 16.

Figure 8B:
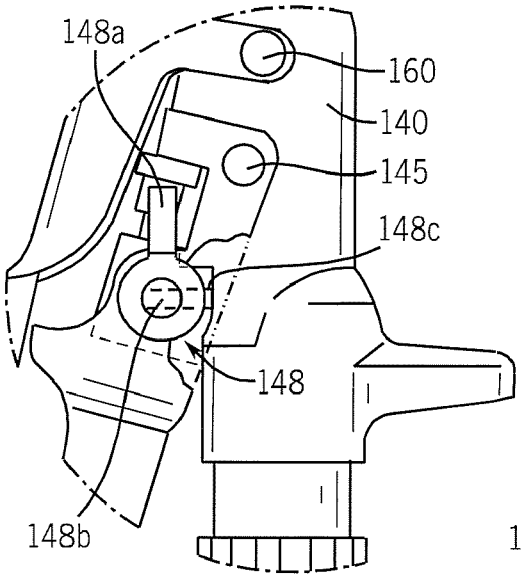
FIGS. 8*a* and 8*b* are enlarged views of a control arrangement for the system.
Figure 8A:
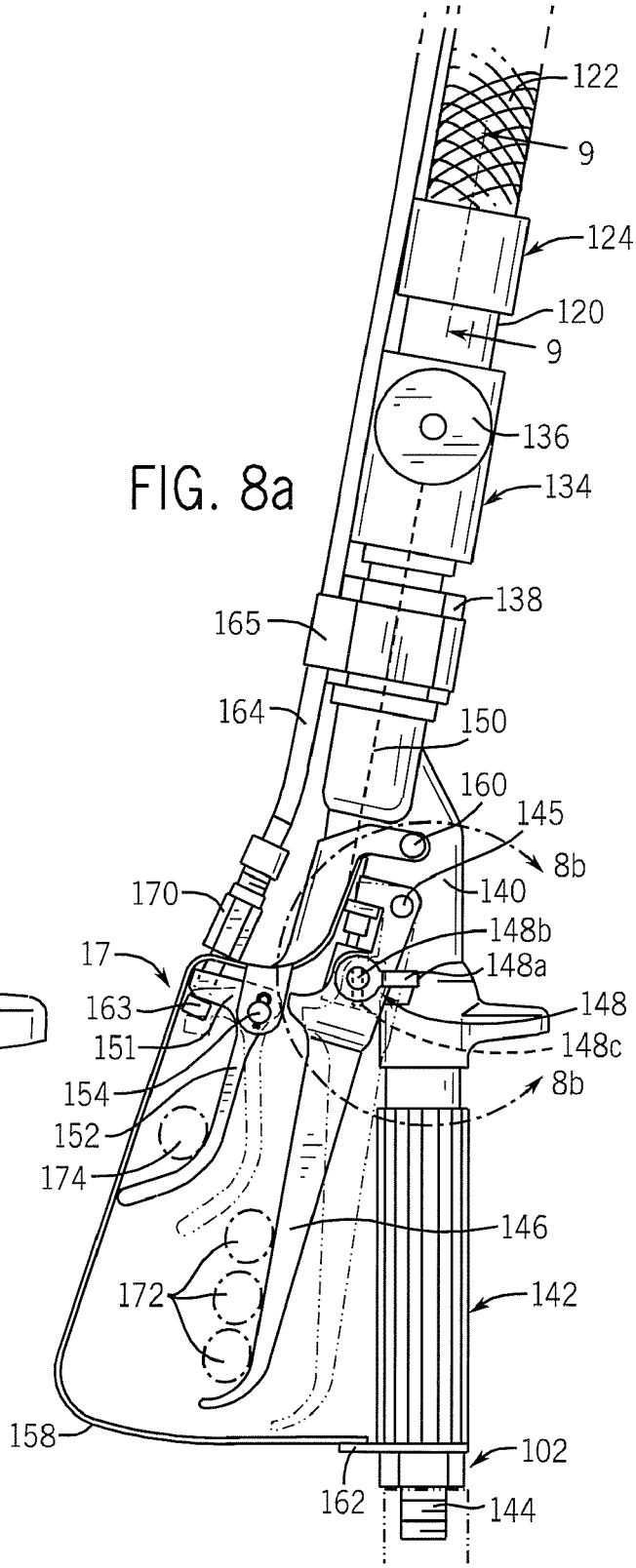

As seen in FIGS. 1, 8*a* and 8*b*, the control arrangement 17 includes a first movable lever 146 pivotally mounted at 145 to the exterior of angled branch 140. The first lever 146 has an unlocked position (FIG. 8*a*) for manually controlling the flow of drywall compound 12 into the delivery tube 16. The first lever 146 has a lock position (FIGS. 1 and 8*b*) for establishing an automatic, continuous flow of drywall compound into the delivery tube 16. The first lever 146 employs a rotatable locking device 148 to attain the locked and unlocked positions. The locking device 148 has a finger lever 148*a* and is rotatably mounted by means of a pin 148*b* passed through the lever 146. The pin 148*b* is provided with a projection 148*c* which is engageable and disengageable with an inner surface of angled branch 140 upon rotation of locking device 148. The first lever 146 is provided with a biased cable arrangement 150 which communicates with valve 118 within the delivery tube 16 to manually vary the volumetric flow of drywall compound 12 thereto when the lever 146 is unlocked. When the first lever 146 is locked, the valve 118 in the delivery tube 16 is held open so that continuous flow may occur.

The control arrangement 17 also includes a second movable lever 152 (FIGS. 6-8) pivotally connected about a pin 154 mounted between a pair of retainers (one being seen at 156). The retainers 156 are secured such as by welding to a handle framework 158 which is attached at a forward end by a fastener 160, and a rearward end to a support element 162 between hand grip 142 and inlet 144. A portion 151 of the second lever 152 is engaged by enlarged end 163 of cable 100 which is protected by an outer casing 164 and runs along the delivery tube 16 up to the movable biased plate arrangement 70. The outer casing 164 may be maintained in place on the delivery tube by one or more retaining bands 165. The cable 100 runs through a metal sleeve 166 held in opening 98 and terminates at cylindrical end 168 which is lodged behind second plate 76 at the dispensing end 106. The cable 100 also passes through another metal sleeve 170 engaged against the handle framework 158 before terminating in end 163. As will be described below, the second lever 152 provides manual control for selectively allowing and preventing pivotal movement of the dispensing head 15 at the dispensing end 106 of the delivery tube 16. The levers 146 and 152 are in tandem or one behind the other, are pivoted about parallel axes and are placed in alignment with the hand grip 142 so that a user may wrap his palm around the hand grip 142 and conveniently access both levers 146 and 152 at the same time with one hand thereby providing complete control of the system 10.

In use during a finishing operation, pressurized drywall compound 12 supplied from compound supply 102 to inlet 144 can be delivered through delivery tube 16 to fill the flat box 15 by setting the pressure regulator 134 as desired and using the first lever 146 in either a manual or an automatic continuous flow mode. This is accomplished by placing the locking device 148 in either the unlocked position of FIG. 8*a* (manual control) or the locked position of FIG. 8*b* (automatic continuous control). Once the flat box 15 has been filled with drywall compound 12 as shown in FIG. 3, the system 10 is placed against the wallboard joint over the tape 14 as shown in FIG. 1 so that the wheels 40,42 on the flat box 15 will run along the wallboard 43. The user generally positions one hand on the delivery tube 16 to stabilize the flat box 15 and apply pressure to the pressure plate 48 so that drywall compound 12 can be dispensed from the outlet slot 34 on flat box 15 over a relatively wide area which will cover and crown the tape joint.

The user's other hand is able to completely control the system 10 by wrapping his/her hand around the hand grip 142 and simultaneously placing some fingers 172 (FIG. 8) on first lever 146 and at least one finger 174 on the second lever 152. During the finishing operation, the flat box 15, which is always filled by the delivery tube 16 in communication with the supply 104, is moved vertically along the wallboard joint. The user always has the option of providing drywall compound 12 in a variable manner by manually controlling the first lever 146 as in FIG. 8*a*, or in an automatic, continuous flow by locking the first lever 146 as shown in FIG. 8*b*, In the unlatched position of FIG. 8*a*, the finger lever 148*a* of locking device 148 is rotated to a horizontal position so that projection 148*c* is disengaged from the angled branch 140. As a result, the lever 146 can be manually adjusted from the solid line position to the phantom line position of FIG. 8*a* so as to vary the flow of drywall compound through conduit 120. In the locked position of FIG. 8*b*, the finger lever 148*a* is rotated to a vertical position so that projection 148*c* is engaged against the angled branch 140. This prevents the lever 146 from any pivoting movement and allows drywall compound to flow at a continuous rate through conduit 120 as set via pressure regulator 134. As the flat box 15 dispenses drywall compound 12, the flat box 15 normally pivots relative to the dispensing end 106 of the delivery tube 16. This is permitted because the ball dispenser 83 is free to move in the socket 53 and openings 74,78,82 of movable biased plate arrangement 70 as shown in FIGS. 6 and 6A. However, it is advantageous at certain points in the finishing operation to lock the flat box 15 relative to the delivery tube 16. To lock the flat box 15 against pivotal movement, the user moves second lever 152 to the phantom line position of FIG. 8, causing cable 100 to be pulled as depicted in FIG. 7. This motion, due to movably mounted plate 48, draws plates 72 and 76 connected thereto towards plate 80 in the direction of arrow A against the bias of springs 94 creating a frictional locking of the ball dispenser 83 by the walls defining the round openings in the plate arrangement 70. When finger pressure on the second lever 152 is released, the springs 94 will return the plates 76 and 80 to their original position so that pivotal movement of the flat box 15 is restored.

In the event that excessive back pressure builds up within the delivery tube 16, such as caused by matter plugging the ball dispenser outlet 112 or a problem with flow from the box 15, the relief valve 124 can be relied up to signal to the user the existence of a problem by a slight leakage of drywall compound 12 from the delivery tube 16. As depicted in FIG. 9, drywall compound 12 under excessive back pressure in supply conduit 120 will seek to escape by pushing against the band 128 and trickling out the open end of deflector 130. Once the drywall compound leakage is noticed, operation may be interrupted until the excessive pressure problem is rectified.

The present invention thus provides a system 10 for eliminating the need to repeatedly rebuild a dispenser box 15 during drywall finishing. The operation, speed, efficiency and versatility of finishing is markedly improved by the provision of the control arrangement 17 which creates convenient one handed control for supplying drywall compound 12 either manually or automatically and continuously while enabling simultaneous control for locking dispenser box 15 when desired in conjunction with a unique, movable, biased plate arrangement 70. A relief valve 124 is incorporated into the delivery tube 16 to facilitate early warning and enable quicker resolution of excessive pressure problems which may occur.

While the invention has been described with reference to a preferred embodiment, those skilled in the art will appreciate that certain substitutions, alterations and omissions may be made without departing from the spirit thereof. Accordingly, the foregoing description is meant to be exemplary only and should not be deemed limitative on the scope of the invention set forth with the following claims.

We claim:

1. A drywall compound dispensing system having a drywall compound dispensing head for applying drywall compound to a wallboard comprising:

a delivery tube for delivering drywall compound entirely therethrough, the delivery tube having a supply end connected to a source of pressurized drywall compound, and a dispenser end opposite to the supply end connected for pivotal movement of the drywall compound dispensing head relative to the dispenser end; and a control arrangement located at the supply end of the delivery tube and provided with a first movable lever spaced from a second movable lever, both the first and second movable levers being grasped and selectively operable by fingers of one hand of a user, the first movable lever having an unlocked position for manually controlling flow of drywall compound into the delivery tube, and a locked position for enabling a continuous flow of drywall compound into the delivery tube, the second movable lever providing manual control for selectively allowing and preventing pivotal movement of the dispenser head at the dispensing end of the delivery tube.

2. The system of claim 1, wherein the delivery tube includes a pressure regulator for controlling volume of flow of drywall compound.

3. The system of claim 1, wherein the delivery tube includes a relief valve for allowing the expulsion of drywall compound out of the delivery tube in the presence of excessive pressure in the delivery tube.

4. The system of claim 3, wherein the relief valve includes a venting hole formed in an outer wall of the delivery tube;

an expandable and retractable shrink sleeve surrounding the delivery tube and normally covering the venting hole; and a deflector collar spaced from and surrounding the shrink sleeve and the delivery tube, the deflector having an open end for expelling drywall compound therefrom.

5. The system of claim 1, wherein the delivery tube includes a knurled tubular hand grip aligned with the first and second levers at the supply end.

6. The system of claim 1, wherein the dispenser end of the delivery tube includes a ball dispenser enabling the pivotal movement of the drywall compound dispensing head.

7. The system of claim 6, wherein the ball dispenser includes a shaft permitting pivotal movement of the drywall compound dispenser head about a horizontal axis only.

8. The system of claim 6, wherein a back wall of the drywall compound dispensing head is provided with a movable plate arrangement for receiving the ball dispenser in a socket formed therein.

9. The system of claim 8, wherein the movable plate arrangement is connected by a cable to the second movable lever.

10. The system of claim 9, wherein the movable plate arrangement includes a first plate connected to the back wall of the dispensing head and having a first opening;

a second plate connected to the first plate and having a second opening;

a third plate connected in spaced biased relationship to the second plate; and a fourth plate connected to the third plate and having an opening for retaining the cable.

11. The system of claim 10, wherein the socket and the first, second and third openings are all in alignment with one another and receive the ball dispenser.

12. The system of claim 11, wherein the second lever and the cable are actuated to pull the second and third plates together and frictionally lock the ball dispenser.

13. The system of claim 9, wherein the drywall dispenser head normally pivots upon the ball dispenser, and actuation of the second movable lever causes the cable to move the plate arrangement such that the ball dispenser is locked into frictional engagement so that there is no pivotal movement of the dispenser head relative to the ball dispenser.

14. The system of claim 1, wherein the drywall compound dispenser head is a dispenser box movable along a wallboard.

15. The system of claim 1, wherein the control arrangement includes a rotatable locking device for placing the first movable lever in the locked and unlocked positions.

16. The system of claim 1, wherein the first lever and the second lever are pivotable about a first pivot axis and a second pivot axis, respectively, which are parallel to each other.

17. In a drywall compound dispensing system including a drywall compound dispensing head for applying drywall compound to a wallboard, the system having a delivery tube for delivering drywall compound entirely therethrough provided with a supply end connected to a source of pressurized drywall compound and a dispenser end opposite to the supply end connected for pivotal movement with the drywall compound dispensing head, the improvement comprising:

a tandem control lever arrangement located at the supply end of the delivery tube and engaged by one hand of a user for optionally providing manual and automatic continuous flow of drywall compound through the delivery tube, and disabling pivotal movement of the dispensing head.

18. The improvement of claim 17, wherein the tandem control lever arrangement is located within a handle framework.

19. The improvement of claim 17, including a movable plate arrangement connected to the dispensing head for allowing and preventing pivotal movement of the dispensing head relative to the dispenser end.

20. The improvement of claim 17, including a relief valve positioned in the delivery tube between the supply end and the dispensing end for allowing the expulsion of drywall compound out of the delivery tube in the presence of excessive presence of drywall compound in the delivery tube.

21. A drywall compound dispensing system having a drywall compound dispensing head for applying drywall compound to a wallboard comprising:

a delivery tube for delivering drywall compound entirely therethrough, the delivery tube having a supply end connected to a source of pressurized drywall compound, and a dispenser end opposite to the supply end connected for pivotal movement of the drywall compound dispensing head relative to dispenser end; and a control arrangement located at the supply end of the delivery tube and provided with a first movable lever spaced from a second movable lever, both the first and second movable levers being grasped and selectively operable by fingers of one hand of a user, the first movable lever manually controlling flow of drywall compound into the delivery tube, and the second movable lever providing manual control for selectively allowing and preventing pivotal movement of the dispenser head at the dispensing end of the delivery tube.

22. In a drywall compound dispensing system including a drywall compound dispensing head for applying drywall compound to a wallboard, the system having a delivery tube for delivering drywall compound entirely therethrough provided with a supply end connected to a source of pressurized drywall compound and a dispenser end opposite to the supply end connected for pivotal movement with the drywall compound dispensing head, the improvement comprising:

a tandem control lever arrangement located at the supply end of the delivery tube and engaged by one hand of a user for controlling flow of drywall compound through the delivery tube, and disabling pivotal movement of the dispensing head.

* * * * *